US005101868A

United States Patent [19]

Balch

[11] Patent Number: 5,101,868

[45] Date of Patent: Apr. 7, 1992

[54] APPARATUS FOR CATCHING AND TEMPORARILY STORING SPILLED OR OVERFLOWED LIQUID

[76] Inventor: Joseph C. Balch, 7665 Balch Way, Salcha, Ak. 99714

[21] Appl. No.: 674,931

[22] Filed: Mar. 26, 1991

[51] Int. Cl.[5] ..... B65B 3/06

[52] U.S. Cl. ..... 141/86; 141/88; 141/337; 222/108; 137/312; 137/363; 52/19; 404/25; 405/52; 220/86.1

[58] Field of Search ..... 141/86, 88, 98, 311 A, 141/337; 7/288; 138/28, 89, 121; 222/108; 137/312, 313, 314, 356, 363-365, 369, 370, 371; 52/19, 20, 21; 404/25, 26; 405/52; 285/57, 226; 277/212 FB; 220/85 F, 85 R, 85 S, 86.1, 281

[56] References Cited

U.S. PATENT DOCUMENTS

| | | | |
|---|---|---|---|
| 4,501,305 | 2/1985 | Zola et al. | 141/86 |
| 4,579,155 | 4/1986 | Zola et al. | 141/86 |
| 4,659,251 | 4/1987 | Petter et al. | 405/52 |
| 4,767,806 | 8/1988 | Podgers et al. | 141/86 X |
| 4,770,317 | 9/1988 | Podgers et al. | 141/86 X |
| 4,793,387 | 12/1988 | LeBlanc et al. | 141/86 |
| 4,960,346 | 10/1990 | Tamayo | 405/52 |

*Primary Examiner*—Ernest G. Cusick
*Attorney, Agent, or Firm*—Donald A. Kettlestrings

[57] ABSTRACT

Apparatus is provided for use in cooperation with a liquid-receiving pipe for catching and temporarily storing spilled or overflowed liquid as the liquid is being transferred into the pipe. An elastic band grips the pipe in liquid-tight relationship, and the band supports the apparatus on the pipe. A flexible sleeve is connected in liquid-tight relationship with the elastic band for fitting over and around the pipe to form an inner liquid-retaining wall. A funnel is connected in liquid-tight relationship with the sleeve for positioning over and around the pipe and over and around the sleeve to form an outer liquid-retaining wall. The funnel cooperates with the sleeve to create a container for catching and temporarily storing the spilled or overflowed liquid.

15 Claims, 2 Drawing Sheets

12'
12
14
16
34
26
24
24
28
30
22
12
38
26
10
24
18
32
36
24
28
22
30
40
16
42
14
12
12
14
16
38
32
36
26
24
30
22
12

APPARATUS FOR CATCHING AND TEMPORARILY STORING SPILLED OR OVERFLOWED LIQUID

BACKGROUND OF THE INVENTION

This invention relates to an overflow or spilled liquid catcher and more particularly to apparatus for use in cooperation with a substantially vertically oriented liquid-receiving pipe for catching and temporarily storing spilled or overflowed liquid as the liquid is being transferred into the pipe.

Spilling of liquids while filling storage tanks frequently occurs which results in contamination of the area and soils around the storage tanks. Liquids, such as heating oil, gasoline and other liquids that are spilled can result in serious and lasting damage to the environment.

It is, therefore, an object of the present invention to provide an inexpensive and simple apparatus for preventing liquid spills while filling storage tanks.

Another object is to provide such an apparatus which is easy to install and to maintain.

A further object of the invention is the provision of apparatus for use in cooperation with a liquid-receiving pipe for catching and temporarily storing spilled or overflowed liquid as the liquid is being transferred into the pipe.

Still another object is to provide such an apparatus which prevents contamination of the area and soils around storage tanks.

A still further object is to provide such an apparatus which prevents the contamination of homeowners and commercial properties.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention includes means for gripping the filling pipe of the storage tank in substantially liquid-tight relationship and for supporting the apparatus of the invention on the pipe; flexible sleeve means connected in substantially liquid-tight relationship with the gripping means for fitting over and around the pipe to form an inner liquid-retaining wall; and funnel means connected in substantially liquid-tight relationship with the sleeve means for positioning over and around the pipe and over and around the sleeve means to form an outer liquid-retaining wall and for cooperating with the sleeve means to create a container for catching and temporarily storing spilled or overflowed liquid as the liquid is being transferred into the pipe.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

DESCRIPTION OF THE PREFERRED EMBODIMENT

Figures 1, 2, 3:
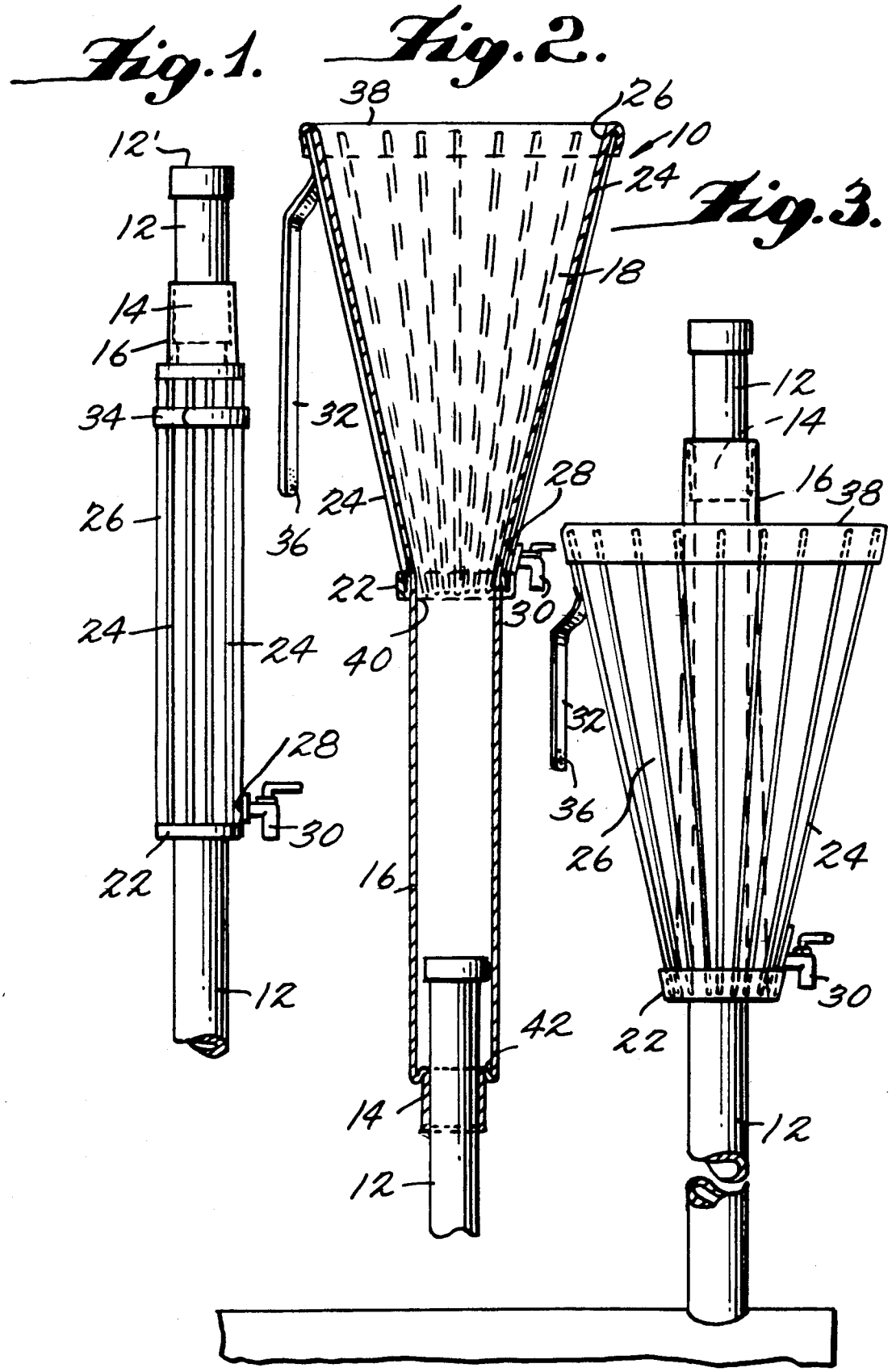
FIG. 1 is an elevation view showing the apparatus on a pipe and in a folded or closed position.
FIG. 2 is a sectional view illustrating the apparatus with the elastic band gripping the pipe and showing the sleeve as it is begun to be pulled downwardly over the elastic band and the pipe.
FIG. 3 is an elevation view showing the apparatus fully installed on the pipe and in an open position to catch and store spilled or overflowed liquid as the liquid is being transferred into the pipe.

With reference now to the drawings, wherein like reference characters designate like or corresponding parts throughout the several views, there is shown apparatus 10 for use in cooperation with a substantially vertically oriented liquid-receiving pipe 12 for catching and temporarily storing spilled or overflowed liquid as the liquid is being transferred into pipe 12.

In accordance with the invention, apparatus 10 includes means 14 for gripping pipe 12 in substantially liquid-tight relationship and for solely supporting apparatus 10 on pipe 12.

Flexible sleeve means 16 are connected in substantially liquid-tight relationship with gripping means or elastic band 14 for fitting over and around pipe 12 to form an inner liquid-retaining wall.

Funnel means 18 are connected in substantially liquid-tight relationship with sleeve means 16 for positioning over and around pipe 12 and over and around sleeve means 16 to form an outer liquid-retaining wall and for cooperating with sleeve means 16 to create a container for catching and temporarily storing spilled or overflowed liquid 20.

Funnel means 18 preferably include a semi-rigid, substantially ring-shaped support element 22 for positioning over and around pipe 12. Support element 22 is preferably comprised of silicone rubber, and element 22 is connected in substantially liquid-tight relationship with sleeve means 16. A plurality of slightly flexible stay elements 24 are flexibly attached to and project upwardly from support element 22, and stay elements 24 are positioned around support element 22 in substantially equally spaced relationship with each other. A flexible sheet 26 of predetermined shape is attached to stay elements 24 and in substantially liquid-tight relationship with support element 22.

Support element 22 is preferably made from General Electric silicone rubber which is placed into a mold (not shown) in an uncured state. Stay elements 24 are then inserted into the uncured silicone rubber, and the rubber is then cured to permanently hold stay elements 24 in flexible relationship with support element 22. Stay elements 24 can be made from spring steel, molded rubber, plastic or even wood.

Neoprene is preferably used for both sheet 26 and for sleeve 16. Sleeve 16 and sheet 26 are attached to support element 22 by using silicone rubber as a glue for creating a liquid-tight seal. Sleeve 16 and sheet 26 can also be attached to support element 22 by sewing the pieces together. Similarly, sleeve 16 can be attached to gripping means 14, which is preferably an elastic rubber band, by molding the two elements together, by attaching the two elements together by glue or by sewing the two elements together.

In accordance with the invention, sheet 26 defines an opening 28 therein adjacent to support element 22, and a drain element or petcock 30 is connected to sheet 26 and in liquid communication with opening 28 for selectively draining spilled or overflowed liquid 20 from apparatus 10. Drain element 30 is preferably attached to sheet 26 by using silicone rubber to create a liquid-tight seal between drain element 30 and sheet 26.

Funnel means 18 preferably further include means 32 in operative relationship with stay elements 24 and with sheet 26 for selectively encircling and retaining the stay elements and the sheet in a predetermined closed position around pipe 12 when retaining means 32 is in a fastened position. This position is illustrated in FIG. 1. Encircling and retaining means 32 preferably include a strap 34 attached to sheet 26 or to one of stay elements 24. Strap 34 is of a predetermined length to enable the strap to encircle stay elements 24, sheet 26 and pipe 12, and means 36, such as Velcro, are provided in operative relationship with strap 34 for fastening the strap in position to hold stay elements 24 and sheet 26 in the fastened or closed position illustrated in FIG. 1.

Figure 4:
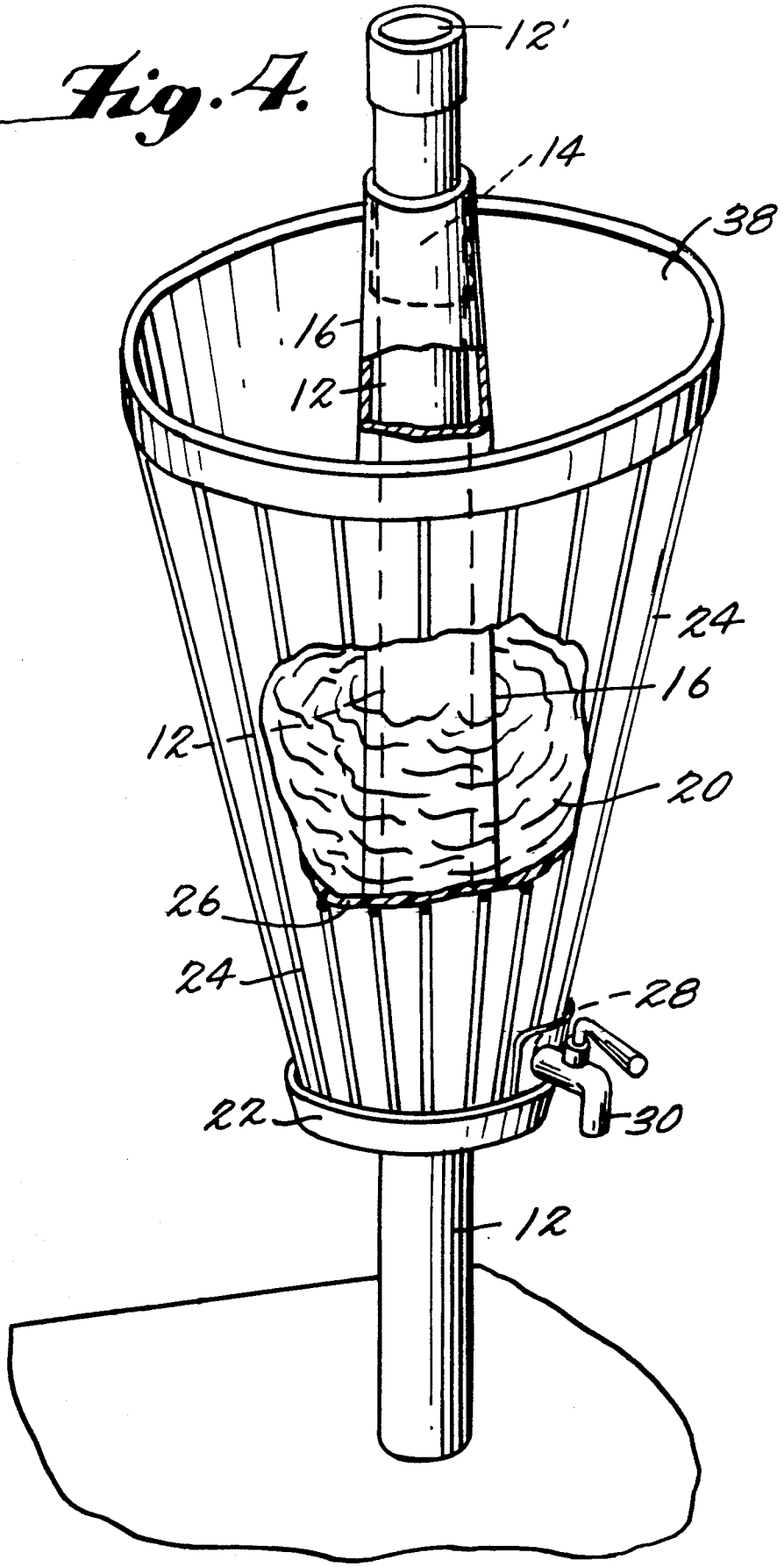
FIG. 4 is a fragmentary perspective view of the apparatus fully installed on the pipe and in an open position and showing some liquid that has been caught and stored by the apparatus.

Stay elements 24 are preferably attached to ring-shaped support element 22 for enabling the stay elements to normally open to positions to form angles of substantially fifteen degrees with respect to pipe 12 when retaining means 32 is in an unfastened or open position, as shown in FIGS. 3 and 4. This will provide a sufficiently large upward opening 38 for funnel means 18 so that spilled or overflowed liquid will be caught and held by funnel 18.

Sleeve means 16 is preferably tapered along its length. Sleeve means 16 defines a first open end 40 attached around its periphery to support element 22 and a second open end 42 attached around its periphery to gripping means 14. Because of the tapered configuration of sleeve 16, opening 40 is larger than opening 42. The tapered shape of sleeve 16 is important for permitting ease of installation of sleeve 16 over pipes 12 of varying sizes and for enabling the sleeve to be drawn downwardly over pipe 12 and to be pulled inside-out as apparatus 10 is attached to the pipe.

Gripping means 14, sleeve means 16 and funnel means 18 are preferably comprised of waterproof and oil-gasoline resistant material so that oil and/or gasoline can be safely caught and stored by apparatus 10. Apparatus 10 is also preferably comprised of materials that are resistant to extremes of heat and cold so that apparatus 10 can be safely used at temperatures ranging from approximately minus eighty-five degrees Centigrade to plus ninety degrees Centigrade. These properties of the materials are necessary because apparatus 10 may be used in areas of widely varying climates.

In operation, elastic rubber band 14 is slipped over the upward free end of pipe 12. Elastic band 14, for example, can be made two inches wide, six millimeters thick and one inch in diameter to be used on a pipe 12 two inches in diameter. Such a band 14 will support weight in excess of forty pounds. Apparatus 10 and funnel 18 are preferably designed to hold up to two liters of spilled liquid. Band 14 tightly grips pipe 12 in substantially liquid-tight relationship with the pipe to prevent liquid from passing between band 14 and pipe 12.

Sleeve 16 and support element 22, together with funnel 18, are then moved downwardly over and around pipe 12, as shown in FIG. 2, so that sleeve 16 is turned inside out and until sleeve 16 is positioned beneath elastic band 14 and adjacent to the outer wall of pipe 12, as shown in FIGS. 3 and 4. In this position, support element 22 and funnel 18 also surround pipe 12, and a container for catching and storing spilled or overflowed liquid is formed by sleeve 16 and sheet 26.

It is anticipated that apparatus 10 will be permanently positioned on pipe 12, but apparatus 10 can be removed from the pipe after each filling operation so that apparatus 10 can be used for a number of tanks and pipes 12 to prevent spillage.

When apparatus 10 is positioned onto pipe 12 and when pipe 12 is not being filled, apparatus 10 is collapsed by moving stay elements 24 and sheet 26 toward pipe 12. Strap 34 is then wrapped around stay elements 24 and sheet 26, and fastening means 36 are used to hold strap 32 in position to keep funnel 18 in the inwardly folded or collapsed position shown in FIG. 1.

When the tank to which pipe 12 is attached is to be filled with liquid, fastener 36 is released and strap 32 loosens to enable stay elements 24 and sheet 26 to open to the position shown in FIGS. 3 and 4. As liquid is then pumped into the upward opening 12' of pipe 12, any liquid that is spilled or overflowed will run down the outer wall of pipe 12 until the liquid comes into contact with elastic band 14. The liquid-tight seal which exists between elastic band 14 and pipe 12 will prevent the liquid from passing between band 14 and pipe 12 and the liquid will be prevented from running down the outer wall of pipe 12 to contaminate the ground or surrounding area.

Because sleeve 16 is attached to elastic band 14 in a liquid-tight relationship, liquid 20 will then run down sleeve 16 and will be trapped in the container formed by sleeve 16 and sheet 26, as shown in FIG. 4. The capacity of the container is typically less than one liter, and this volume is sufficient to collect and store all but the most serious of spills or overflows.

After the storage tank has been filled, liquid 20, which has been caught and held by the container formed by sleeve 16 and sheet 26, can then be drained from the container by opening petcock 30. After liquid 20 has been drained, petcock 30 is then closed. Stay elements 24 and sheet 26 are then moved toward pipe 12 and into the closed position shown in FIG. 1. Strap 32 is then used to encircle stay elements 24 and sheet 26, and fastener 36 is used to hold strap 32 in position. In this closed position, rain or snow is substantially prevented from being collected within funnel 18 when apparatus 10 is not in use. If some rain is collected within funnel 18 when apparatus 10 is not in use, petcock 30 can be opened to drain the water from funnel 18 before liquid 20 is introduced into pipe 12. This will avoid the mixture of rain water and liquid 20 when the spilled liquid is collected by apparatus 10.

Sheet 26 is preferably approximately one inch longer than the length of each of stay elements 24. This permits the upper edge of sheet 26 to be folded over the upper ends of stay elements 24, and the upper ends of the stay elements are then glued or otherwise conventionally attached to sheet 26. By attaching the upper ends of each of stay elements 24 to sheet 26, stay elements 24 are maintained in proper spacing from each other, and sheet 26 is prevented from sliding or slipping with respect to stay elements 24. It is contemplated that stay elements 24 can be positioned either inside or outside of sheet 26.

The invention in its broader aspects is not limited to the specific details shown and described, and departures may be made from such details without departing from the principles of the invention and without sacrificing its chief advantages.

I claim:

1. Apparatus adapted for use in cooperation with a liquid-receiving pipe for catching and temporarily storing spilled or overflowed liquid as the liquid is being transferred into the pipe, said apparatus comprising:

means for gripping said pipe in substantially liquid-tight relationship and for solely supporting said apparatus on said pipe;

flexible sleeve means connected in substantially liquid-tight relationship with said gripping means for fitting over and around said pipe to form an inner liquid-retaining wall; and funnel means connected in substantially liquid-tight relationship with said sleeve means for positioning over and around said pipe and over and around said sleeve means to form an outer liquid-retaining wall and for cooperating with said sleeve means to create a container for catching and temporarily storing spilled or overflowed liquid.

2. Apparatus as in claim 1 wherein said funnel means include:

a substantially ring-shaped support element for positioning over and around said pipe, said support element connected in substantially liquid-tight relationship with said sleeve means;

a plurality of stay elements flexibly attached to and projecting upwardly from said ring-shaped support element and positioned around said ring-shaped support element in predetermined spaced-apart relationship with each other; and a flexible sheet of predetermined shape attached to said plurality of stay elements and in substantially liquid-tight relationship with said ring-shaped support element.

3. Apparatus as in claim 2 wherein said sheet defines an opening therein adjacent to said ring-shaped support element and wherein said funnel means further include a drain element in operative relationship with said opening for selectively draining spilled or overflowed liquid from said apparatus.

4. Apparatus as in claim 3 wherein said drain element is attached in substantially liquid-tight relationship to said sheet.

5. Apparatus as in claim 4 wherein said drain element is a petcock.

6. Apparatus as in claim 4 wherein said funnel means further include means in operative relationship with said stay elements and with said sheet for selectively encircling and retaining said stay elements and said sheet in a predetermined closed position around said pipe when said retaining means is in a fastened position.

7. Apparatus as in claim 6 wherein said stay elements are attached to said ring-shaped support element for enabling said stay elements to open to positions to form angles of substantially fifteen degrees with respect to said pipe when said retaining means is in an unfastened position.

8. Apparatus as in claim 7 wherein said gripping means, said sleeve means, and said funnel means are comprised of waterproof and oil/gasoline resistant material, whereby oil and/or gasoline can be safely caught and stored by said apparatus.

9. Apparatus as in claim 8 wherein said apparatus is comprised of material which is resistant to extremes of heat and cold, whereby said apparatus can be safely used in temperatures from −85° C. to +90° C.

10. Apparatus as in claim 9 wherein said ring-shaped support element is comprised of silicone rubber.

11. Apparatus as in claim 9 wherein said sheet and said sleeve means are comprised of neoprene rubber.

12. Apparatus as in claim 6 wherein said encircling and retaining means include a strap attached to said sheet and of predetermined length to encircle said stay elements said sheet and said pipe, and means in operative relationship with said strap for fastening said strap in position to hold said stay elements and said sheet in said fastened position.

13. Apparatus as in claim 1 wherein said gripping means is an elastic band.

14. Apparatus as in claim 1 wherein said sleeve means is tapered along its length.

15. Apparatus as in claim 14 wherein said sleeve means defines a first open end attached to said ring-shaped support element and a second open end attached to said gripping means, and wherein the opening defined at said first end is greater than the opening defined at said second end.

* * * * *